US012716178B2

(12) United States Patent
Hemphill et al.

(10) Patent No.: US 12,716,178 B2
(45) Date of Patent: Aug. 25, 2026

(54) CONCRETE UNDERDECK REPAIR DEVICE

(71) Applicant: Zero Lamotte Street, LLC, Wilmington, DE (US)

(72) Inventors: W. Scott Hemphill, Wilmington, DE (US); Austin T. Bender, North East, MD (US); M. Scott McCormick, Newark, DE (US)

(73) Assignee: Zero Lamotte Street, LLC, Wilmington, DE (US)

( * ) Notice: Subject to any disclaimer, the term of this patent is extended or adjusted under 35 U.S.C. 154(b) by 498 days.

(21) Appl. No.: 18/376,296

(22) Filed: Oct. 3, 2023

(65) Prior Publication Data

US 2024/0110341 A1 Apr. 4, 2024

Related U.S. Application Data

(60) Provisional application No. 63/412,642, filed on Oct. 3, 2022.

(51) Int. Cl.
*E01C 11/00* (2006.01)
*E01C 11/04* (2006.01)

(52) U.S. Cl.
CPC ..... *E01C 11/005* (2013.01); *E01C 11/04* (2013.01)

(58) Field of Classification Search
CPC ..... E01C 11/005; E01C 11/04; E02D 22/00
USPC ..... 14/74.5, 77.1, 748
See application file for complete search history.

(56) References Cited

U.S. PATENT DOCUMENTS

| | | | | |
|---|---|---|---|---|
| 6,857,156 | B1 * | 2/2005 | Grossman | E01D 19/125 14/73.1 |
| 7,003,837 | B2 * | 2/2006 | Pollard | E01D 21/00 14/77.1 |
| 8,453,406 | B2 * | 6/2013 | Platt | E04C 3/294 14/73.1 |
| 8,826,481 | B1 * | 9/2014 | Haydu | E01D 19/005 404/69 |
| 2012/0000020 | A1 * | 1/2012 | Newton | E01D 19/125 14/77.1 |

FOREIGN PATENT DOCUMENTS

| | | | | |
|---|---|---|---|---|
| CN | 209384378 U | * | 9/2019 | |
| CN | 110984381 A | * | 4/2020 | E04B 1/2403 |
| KR | 2005065075 A | * | 6/2005 | E01D 2/00 |

* cited by examiner

*Primary Examiner* — Raymond W Addie
(74) *Attorney, Agent, or Firm* — UB Greensfelder LLP; Brian E. Turung

(57) ABSTRACT

A plate system for use in repairing the flange-to-flange connections for pre-cast and pre-stressed double tee systems by connecting the plate system to the underside of the flange-to-flange connections.

20 Claims, 10 Drawing Sheets

A - TYPICAL CONSTRUCTION CONCRETE ANCHOR
-EXPANSION TYPE
-WEDGE TYPE
-ADHESIVE BONDED

B - DIRECT SCREW IN STYLE ANCHOR

C - THRU BOLT (WITH OR WITHOUT COUNTER SUNKTOP)

CONCRETE UNDERDECK REPAIR DEVICE

REFERENCED APPLICATIONS

The present application claims priority to U.S. Provisional Application Ser. No. 63/412,642 filed Oct. 3, 2022, which is incorporated herein by reference.

FIELD OF DISCLOSURE

The present disclosure is directed to reinforcement systems. The present disclosure is particularly applicable for use with paved surfaces such as, but not limited to, roads, parking lots, sidewalks, jogging and bike paths, etc. The installation of fiber-reinforced polymer (FRP) in slots cut into concrete is a technique developed over the years by the concrete repair industry and has become the generally accepted way to repair pre-cast concrete. The present disclosure is directed to a method and apparatus for strengthening concrete, more particularly directed to a method and apparatus for strengthening and/or repairing concrete connections, and still more particularly directed to a method and apparatus for repairing the flange-to-flange connections for pre-cast and pre-stressed double tee systems by connecting a device on the underside of the flange-to-flange connections for pre-cast and pre-stressed double tee systems.

BACKGROUND OF THE DISCLOSURE

Concrete structures are commonly used for buildings, parking garages, and the like. Over time, cracks can develop within concrete structures. If such cracks are left unrepaired, the cracks can result in failure of the structure. This is a particular problem for parking garages wherein large loads from vehicles daily travel over the concrete surface. To prevent the failure of the concrete structure without having to replace the structure, the damaged concrete structure is often repaired by cutting the damaged section away from a pre-existing concrete section, and then pouring new concrete into the cutout portion. However, new concrete does not always bond perfectly with the pre-existing concrete, thus resulting in the propagation of cracks in the joint between the old and new concrete.

Other methods have been used to repair damaged concrete structures and to maintain the mechanical connection between the new concrete section and a pre-existing concrete section. One prior art repair method involves first removing the damaged concrete and then drilling holes in the pre-existing concrete using a rotary impact hammer drill. Thereafter, an adhesive is placed into the holes, and reinforcing bars are inserted such that the bars extend beyond the outer wall of the pre-existing concrete and are generally perpendicular to the joint between the pre-existing concrete section and the gap defining the area where the new concrete is to be poured. The new concrete is then poured adjacently to the pre-existing concrete such that the ends of the reinforcing bars extend into the new concrete and bond with the new concrete when the new concrete cures. As a result, when the new concrete cures, it will be joined to the pre-existing concrete via the reinforcing bars. When attaching external fixtures to pre-existing concrete sections, holes are commonly drilled using a standard rotary drill, and the anchors are either bonded or friction-fitted within the drilled holes. The external fixtures are then mounted onto the anchors.

Several disadvantages are associated with these past methods of repair and attachment of newly poured concrete. For instance, the drilling of multiple holes into the existing concrete is a slow and labor intensive process. Additionally, the vibrations associated with the drilling of the holes can cause an entire section of concrete to fail. Moreover, once a hole is drilled, it must be subsequently cleaned of dust and concrete particles in order to permit the adhesive to properly bond to the concrete. Furthermore, cracks can form over time in the joint between the new concrete section and the pre-existing concrete. As such, when moisture seeps down these cracks, the metallic reinforcing bars will rust, corrode, and subsequently fail, thereby necessitating further repair of the concrete section. Also, a phenomenon known in the industry as "burping" may occur, whereby air pockets become trapped within the hole once the reinforcing bar is installed, thereby preventing at least a portion of the adhesive from bonding with the reinforcing bar. Such defective bonding can lead to premature failure of the reinforced joint.

The repair of concrete structures such as a parking garage structure, a concrete driveway, or the like that is disposed above T-shaped concrete beams can be problematic. The concrete structures are typically joined together by metal clips. As cracks form in the concrete structures, moisture seeps into the concrete supports and corrodes the metal clips. Such metal clip corrosion ultimately causes the metal clip to fail, which can result in the collapsing of a concrete slab within the parking garage. One prior art method to repair this type of damage involves welding or bolting a supplemental joining apparatus to both supports, thereby retaining them together. This method is expensive and labor intensive. Additionally, the repair is aesthetically unappealing. Another prior art method to repair this type of damage involves cutting through the concrete to access and replace the failed metal clip. Again, this process is labor intensive and expensive.

Another prior art method to repair concrete structures disposed above T-shaped concrete beams is disclosed in U.S. Pat. No. 6,312,541, which is incorporated herein by reference. The '541 patent discloses the use of a half-moon-shaped molded composite insert that is inserted into a cut slot in the concrete slab. The slot is cut generally perpendicular to the T-shaped concrete beams and across the gap between two concrete structures. An epoxy material is used to secure the composite insert in the cut slot. The composite insert includes a plurality of cavities that facilitate in the bonding of the composite insert within the cut slot in the concrete slab. Although the molded composite insert is an improvement over prior art methods to repair damaged concrete, there remains a continued need to improve the strength and durability of the repaired concrete.

Another prior art method to repair concrete structures disposed above T-shaped concrete beams is disclosed in U.S. Pat. No. 8,567,146, which is incorporated herein by reference. The '146 patent discloses a composite material for use in repairing concrete. A slot is cut into two adjacently positioned concrete slabs and the composite material is inserted into the cut and adhesively connected to the concrete slabs. Although the composite insert is an improvement over prior art methods to repair damaged concrete and/or to connect together adjacently positioned concrete slabs, the repair process requires that a slot be cut in the concrete deck.

Another prior art method to repair concrete structures for T-shaped concrete beams is disclosed in U.S. Pat. No. 8,800,232, which is incorporated herein by reference. The '232 patent discloses a flexible flange connection for use in a concrete structure that allow for deflection of adjacent pre-cast structures at or near the flange connection. The connection system utilizes a plurality of components that make the use of the flange connection system complicated and cumbersome.

In view of the current prior art methods to repair concrete, there remains a continued need to improve the strength and durability of the repaired concrete and/or connected concrete and to reduce cracking in the repaired and/connected concrete.

SUMMARY OF THE DISCLOSURE

The present disclosure is directed to a method and apparatus for connecting, strengthening, and/or repairing concrete connections, and more particularly directed to a method and apparatus for repairing the flange-to-flange connections for pre-cast and pre-stressed double tee systems; however, it can be appreciated that the method can be used to connect other concrete systems and other non-concrete systems. The method and apparatus of the present disclosure includes the use of an improved plate system that is secured to the bottom region of the concrete. The method of the present disclosure is simple to implement, generally less expensive than welding a supplemental joining apparatus to the concrete, and eliminates the need to cut slots into the top surface of the deck of the concrete, thus minimizing the need to close off the complete concrete structure during the repair and/or connection process. In one non-limiting embodiment, the method of the present disclosure is absent the use of welding.

In one non-limiting aspect of the present disclosure, the improved plate system has a shape such that the improved plate system is generally located on each side of the central longitudinal axis of the connection location (e.g., central axis of the flange-to-flange connection for pre-cast and pre-stressed double tee systems, etc.). In one non-limiting embodiment, the improved plate system has a plate body wherein the length that is greater or equal to the width. In one non-limiting embodiment, the maximum longitudinal length of the improved plate system is 6-25 inches (and all values and ranges therebetween), and typically 8-16 inches. In another non-limiting embodiment, the maximum width of the improved plate system is 4-25 inches (and all values and ranges therebetween), and typically 6-14 inches. In another non-limiting embodiment, the thickness of the improved plate system is 0.1-3 inches (and all values and ranges therebetween), and typically 0.25-2 inches. In another non-limiting embodiment, the improved plate system includes a plurality of connections arrangements and each side of the central latitudinal axis (e.g., axis that is perpendicular to the longitudinal axis of the improved plate system and which axis passing through midpoint of the longitudinal length of the improved plate system) of the improved plate system generally has the same number of connection arrangements (e.g., 1-10 connection arrangement on each side and all values and ranges therebetween); however, this is not required. Such connection arrangements include, but are not limited to, holes, slots, clips, recesses, hooks, flanges, etc. In one non-limiting configuration, a plurality of the connection arrangements are the same shape, size, and/or configuration. In another non-limiting configuration, all of the connection arrangements are the same shape, size, and/or configuration. In another non-limiting configuration, at least one of the connection arrangements is in the form of a hole through the complete thickness of the improved plate system. In another non-limiting configuration, all of the connection arrangements are in the form of holes through the complete thickness of the improved plate system. When one or more of the connection arrangements are in the form of a hole, a screw, bolt, pin, rod, clip, cord, chain, etc. can be partially inserted into and/or through the hole to facilitate in the securing of the improved plate system to the concrete surface or other surface to be repaired. In another non-limiting aspect of the present disclosure, the improved plate system includes a plurality of connections arrangements that are spaced apart from one another and each side of the central latitudinal axis of the improved plate system has the same number of connection arrangements. In one non-limiting embodiment, the improved plate system has the same shape, size and/or thickness on each side of the central latitudinal axis of the improved plate system. In another non-limiting embodiment, the improved plate system has the same shape, size and thickness on each side of the central latitudinal axis of the improved plate system. In another non-limiting embodiment, the improved plate system has the same shape and size and a different thickness on each side of the central latitudinal axis of the improved plate system.

In another non-limiting aspect of the present disclosure, the improved plate system is circular or oval shaped. In another non-limiting configuration, the improved plate system has an even number of sides. In one non-limiting specific arrangement, the improved plate system has four, six, or eight sides. In another one non-limiting specific arrangement, the improved plate system has four sides. In another one non-limiting specific arrangement, the improved plate system has four sides, and at least two of the opposite facing sides have a non-linear shape (e.g., outward curved shape, inward curved shape, wave shape, U-shaped, C-shaped, S-shaped, etc.). In another one non-limiting specific arrangement, the improved plate system has four sides, and each of the opposite facing sides have a non-linear shape (e.g., outward curved shape, inward curved shape, wave shape, U-shaped, C-shaped, S-shaped, etc.). In another one non-limiting specific arrangement, the improved plate system has four sides, and each of the opposite facing sides have an inward curved shape, and the opposite sizes have the same shaped inward curved shape. In one non-limiting embodiment, the curved profile on one or more of the sides of the improved plate system are configured to curve inwardly to cause a reduction in longitudinal length and/or width of the improved plate system. In one non-limiting configuration, the radius of curvature of the curved profile located on a portion or along the full length of one or more sides of the improved plate system is a radius of curvature of 2-16 inches (and all values and ranges therebetween), and typically 3-8 inches.

In another non-limiting aspect of the present disclosure, the improved plate system includes a plurality of corner regions and each corner region includes a connection arrangement. In one non-limiting arrangement, when the improved plate system includes an even number of corners, a same number of connection arrangement are located on each side of the central latitudinal axis of the improved plate system, and the connection arrangements that are located in each of the corners can be oriented such that an axis through each of the connection arrangement passes within ±10% of the width of the improved plate system (and all values and ranges therebetween). In one non-limiting configuration, the improved plate system includes four (4) corners and a single connection arrangement located at each corner region, and each of the connection arrangements have the same size and/or shape. In another non-limiting configuration, the improved plate system includes four (4) corners and a single connection arrangement located at each corner region, and each of the connection arrangements have the same size and/or shape, and each of the connection arrangement are spaced from the outer perimeter of the improved plate system, and are spaced at similar distances from the outer perimeter of the improved plate system.

In another non-limiting aspect of the present disclosure, the improved plate system is formed of a durable material (e.g., metal, ceramic, fiber material, etc.). The improved plate system can be formed of one or more layers of material. In one non-limiting embodiment, the improved plate system is formed of less than 50 wt. % metal (e.g., 0-49.99 wt. % and all values and ranges therebetween). In another non-limiting embodiment, the improved plate system is formed of less than 10 wt. % metal. In another non-limiting embodiment, the improved plate system is partially or fully formed of a fiber and adhesive system. The fibers that can be used in the improved plate system include, but are not limited to, carbon fibers, glass fibers, aramid fibers [Kevlar™ Twaron™, etc.], boron fibers, hemp fibers, basalt fibers, nylon fibers, Dyneema™ fibers, Zylon™ fibers, fiberglass fibers, etc. The improved plate system can include a single type of fiber or multiple types of fiber. The fibers can be partially or fully coated, partially or fully saturated, and/or partially or fully incorporated in an adhesive material. The improved plate system can be partially or fully formed of a) one or more layers of fibers wherein the fibers are oriented in a parallel relationship to one another, b) two or more layers of fibers that are oriented in a nonparallel relationship to one another, and/or c) one or more fiber layers wherein each fiber layer includes two or more layers of fibers oriented in a non-parallel relationship to one another and wherein the two or more layers of fiber in the fiber layer are woven or non-woven. The one or more layers of fibers can be connected together by adhesive, stitching, heat bonding, adhesive stapling, partially or fully coated and/or immersed with/in a resin material and/or other type of polymer material, and/or by some other connection arrangement. In one non-limiting embodiment of the disclosure, the improved plate system can include one or more layers of fiber or an aggregate of fibers that have a tensile strength of at least about 50 KSI. The tensile strength is the maximum stress that the fiber can withstand before failure of the fiber. In one non-limiting aspect of this embodiment, the improved plate system includes one or more layers of fiber or an aggregate of fibers that have a tensile strength of about 50-800 KSI (and all values and ranges therebetween). In another non-limiting aspect of this embodiment, the improved plate system includes one or more layers of fiber or an aggregate of fibers having a tensile strength of at least about 200 KSI. In another non-limiting aspect of this embodiment, the improved plate system includes one or more layers of fiber or an aggregate of fibers having a tensile strength of at least about 300 KSI. In another non-limiting aspect of this embodiment, the improved plate system includes one or more layers of fiber or an aggregate of fibers having a tensile strength of about 300-700 KSI. In another non-limiting aspect of this embodiment, the improved plate system includes one or more layers of fiber or an aggregate of fibers having a tensile strength of about 350-675 KSI. In another and/or alternative non-limiting embodiment of the disclosure, the improved plate system can include one or more layers of fiber or an aggregate of fibers having a tensile modulus of at least about 3 MSI. Tensile modulus is an indicator of the stiffness of the fiber. Tensile modulus is the applied stress on the fiber, based on force and cross-sectional area of the fiber, divided by the observed strain at such stress level. In one non-limiting aspect of this embodiment, the improved plate system includes one or more layers of fiber or an aggregate of fibers having have a tensile modulus of about 3-60 MSI (and all values and ranges therebetween). In another non-limiting aspect of this embodiment, the improved plate system includes one or more layers of fiber or an aggregate of fibers having a tensile modulus of at least about 5 MSI. In another non-limiting aspect of this embodiment, the improved plate system includes one or more layers of fiber or an aggregate of fibers having a tensile modulus of at least about 8 MSI. In another non-limiting aspect of this embodiment, the improved plate system includes one or more layers of fiber or an aggregate of fibers having a tensile modulus of about 10-50 MSI. In another non-limiting aspect of this embodiment, the improved plate system includes one or more layers of fiber or an aggregate of fibers having a tensile modulus of about 10-35 MSI. The adhesive material and/or resin/polymer coating included in the improved plate system generally includes vinyl ester resins, epoxy resins, polyester resins, acrylic resins, polyurethane resins, phenolic resins, alkyd resins, polycarbonate resins, polyamide resins, and/or silicone resins. In another non-limiting embodiment of the disclosure, the adhesive material and/or resin/polymer coating includes resin material. In another non-limiting embodiment of the disclosure, the adhesive material and/or resin/polymer coating includes resin material that includes a vinyl ester resin. In another non-limiting embodiment of the disclosure, the adhesive material and/or resin/polymer coating includes a resin material that includes an epoxy resin.

In another and/or alternative non-limiting aspect of the present disclosure, the improved plate system optionally includes one or more outer layers of dielectric insulating material. The dielectric insulating material can be located on the top and/or bottom surface of the improved plate system. The thickness of each of the layers of dielectric insulating material is generally 0.01-3 inches (and all values and ranges therebetween). As used herein, a dielectric insulating material is a material having low conductivity and which creates obstruction in the flow of current. As defined herein, a dielectric insulating material has an electrical conductivity of less than $5.5\times10^{-3}$ S/m, and typically, a dielectric insulating material has an electrical conductivity of less than $5.5\times10^{-6}$ S/m. Non-limiting examples of dielectric insulating material includes fiberglass fiber layers, Kevlar™ fiber layers, resin material layers, etc. In one non-limiting embodiment of the disclosure, the improved plate system includes one or more fiberglass layers on the top and/or bottom surface of the improved plate system.

In another and/or alternative non-limiting aspect of the present disclosure, the improved plate system can optionally include two or more layers of fibers oriented in a nonparallel relationship to one another. In one particular configuration, one fiber layer runs in a plane nonparallel to the longitudinal axis of another fiber layer (e.g., +45° & −45°, +30° & −30°, +60° & −60°, +15-75° (and all values and ranges therebetween) & −15-75° (and all values and ranges therebetween), etc.).

In another and/or alternative non-limiting aspect of the present disclosure, the improved plate system is optionally at least partially formed by saturating and/or impregnating one or more fiber layers with an adhesive and/or resin/polymer material (e.g., resin material, etc.) and then pressing the adhesive and one or more fiber layers together until the adhesive and/or resin/polymer material dries and/or cures. A vacuum can optionally be applied during the pressing and drying/curing steps. The process for forming the improved plate system can be by a batch process or a continuous process. The adhesive material and/or resin/polymer material can be pre-applied and/or applied as the one or more fiber layers are brought together.

In another and/or alternative non-limiting aspect of the present disclosure, the improved plate system includes curved corners. The radius of curvature of the curved corners is generally about 0.1-2 inches (and all values and ranges therebetween).

In another and/or alternative non-limiting aspect of the present disclosure, the improved plate system has a tensile strength along the x-y axis or longitudinal axis of at least about 50 KSI (e.g., 50-150 KSI and all values and ranges therebetween), a compressive strength along the x-y axis or longitudinal axis of at least about 40 KSI (e.g., 40-135 KSI and all values and ranges therebetween), a compressive strength through the z axis or thickness of at least about 5 KSI (e.g., 5-12 KSI and all values and ranges therebetween), a shear strength through the z axis or thickness of at least about 10 KSI (e.g., 10-30 KSI and all values and ranges therebetween), and/or an inter laminar shear along the x-y axis or longitudinal axis of at least about 1 KSI (e.g., 1-3 KSI and all values and ranges therebetween).

In another and/or alternative non-limiting aspect of the present disclosure, the improved plate system includes a base plate and one or more detachable shims on one or both sides of the base plate of the improved plate system. The shims adjust the surface profile of the top surface of the improved plate system (e.g., adjust thickness of the improved plate system, etc.) for instances when the improved plate system is to be connected to non-flush or non-level concrete surfaces. In many situations, the bottom surface of two separated concrete structures or slabs may not be flush or level with one another. In such a situation, when a rigid or semi-rigid plate is connected to one concrete surface positioned lower than the other concrete surface, a space exists between the plate and the other concrete surface. As such, when the plate is secured to both concrete surfaces, the plate is caused to bend. Such bending of the plate can result in damage to the plate. To avoid this problem, shims have typically been used to fill the gap. However, the size and shape of the shims can still result in the plate system not being properly connected to the concrete. Also, the use of shims on one section of the concrete and not the other can result in non-uniform forces being applied to the two connected concrete structures, thereby increasing the incidence of cracking. The improved plate system of the present disclosure overcomes this significant problem. In one non-limiting embodiment, the improved plate includes one or more removable layers, removable sections, or shims on a top portion and/or bottom surface of the base plate of the improved plate system. The one or more removable layers, removable sections, or shims address the unevenness of two adjacently positioned concrete sections when connecting the improved plate system to such concrete sections. In one non-limiting configuration, the improved plate system includes a single removable layer, removable section, or shim. In another non-limiting configuration, the improved plate system includes a plurality of removable layers or removable sections or shims. In another non-limiting configuration, each removable layer, removable section, or shim has the same shape or configuration, and optionally the same thickness. In another non-limiting configuration, each removable layer, removable section, or shim has the shape of half or nearly half (e.g., 40-60% of the top surface and all values and ranges therebetween) the top surface of the improved plate system. In another non-limiting configuration, one or more or all of the removable layer, removable section, or shim to not overlay the central latitudinal axis of the improved plate system. The removable layer, removable section, or shim can be formed of one or more layers of material (e.g., metal, wood, ceramic, fiber layer, etc.) that are detachable connected to base plate of the improved plate system or to another removable layer, removable section, or shim. In one non-limiting configuration, one or more or all of the removable layers, removable sections, or shims are formed of the same material as the material used to form the base plate. In another non-limiting configuration, one or more or all of the removable layers, removable sections, or shims are formed of a different material from the material used to form the base plate. In another non-limiting configuration, the size, shape and/or material of two or more of the removable layers, removable sections, or shims can be the same or different. The detachable connection for the one or more removable layers, removable sections, or shims can be formed by 1) a breakable bonding material, 2) a breakable clip, 3) a breakable groove, 4) breakable seam, etc.). Such detachable connection is generally selected so as to minimize or prevent damage to the base plate and/or another one of the removable layers, removable sections, or shims that remain connected to the improved plate system when the removable layer, removable section, or shim is removed from the improved plate system. In another non-limiting configuration, the one or more of the removable layers, removable sections, or shims are only positioned on or above the top surface of the base plate. In use, the one or more removable layers, removable sections, or shims can optionally be used only when required. For example, there is provided an improved plate system including one removable layer, removable section, or shim that each have a thickness of 5-50% (and all values and ranges therebetween) the total thickness of the improved plate system, absent the thickness of any ribs or reinforcement structures. The improved plate system is to be connected to the bottom surface of two adjacently positioned concrete sections. The bottom surface of the concrete sections that are to be connected are flush or level. In such arrangement, the one removable layer, removable section, or shim remains in its original position and is not removed from the improved plate system when the improved plate section is connected to the bottom surface of the two concrete sections. In another example, there is provided an improved plate system that includes one removable layer, removable section, or shim. The improved plate system is to be connected to the bottom surface of two adjacently positioned concrete sections. The bottom surface of concrete section 1 is not non-flush or is uneven with the bottom surface of concrete section 2. In this example, the bottom surface of concrete section 1 extends below the bottom surface of concrete section 2. In such arrangement, the one removable layer, removable section, or shim is removed from the top surface of one side of the improved plate section. A majority (e.g., 55-100% and all values and ranges therebetween) of the region of the improved plate section where the removable layer, removable section, or shim was removed is positioned against the bottom surface of concrete section 1 and a majority (e.g., 55-100% and all values and ranges therebetween) of the other half of the improved plate section wherein a removable layer, removable section, or shim has not been removed from the improved plate system is positioned against the bottom surface of concrete section 2.

In another and/or alternative non-limiting aspect of the present disclosure, the improved plate system can optionally include one or more ribs or stiffness structures to increase the stiffness and/or strength of the improved plate system (e.g., improve vertical and/or horizontal stiffness of the improved plate system). When such ribs or stiffness structures are optionally used, such ribs or stiffness structures are generally positioned on the bottom surface of the improved plate system (e.g., bottom surface of the base plate of the improved plate system, etc.); however, this is not required. The materials used to form the ribs or stiffness structures are non-limiting (e.g., metal, wood, ceramic, plastic, fiber composite, etc.). In one non-limiting configuration, the material used to form the ribs or stiffness structures includes less than 50 wt. % metal (e.g., 0-49.99 wt. % and all values and ranges therebetween). In another non-limiting configuration, the material used to form the ribs or stiffness structures is formed of 10-100% (and all values and ranges therebetween) of the same material used to form the base plate of the improved plate system. The shape and size and material of the ribs or stiffness structures are also non-limiting. In one non-limiting embodiment, there is provided a single rib structure that runs generally centrally (±10%) down the full or partial (e.g., 30-99.99% of the longitudinal length and all values and ranges therebetween) longitudinal length of the improved plate system. In another non-limiting embodiment, there is provided two rib structures that run down the full or partial (e.g., 30-99.99% of the longitudinal length and all values and ranges therebetween) longitudinal length of the improved plate system and are spaced on each size of the central latitudinal axis of the improve plate system. In another non-limiting embodiment, there is provided two rib structures that run parallel to opposite sides of latitudinal central axis of the improved plate system and are generally spaced equal distances from the latitudinal central axis of the improved plate system. In another non-limiting embodiment, there is provided two rib structures that are located on each side latitudinal central axis of the improved plate system and each of the rib structures has a non-linear shape (e.g., curved, S-shaped, C-shaped, L-shaped, etc.) and are generally spaced equal distances from the latitudinal central axis along the longitudinal length of the improved plate system. In another non-limiting embodiment, one or more rib structures can optionally be configured to partially or fully encircle one or more connection arrangements (e.g., hole through the improved plate system, etc.). Such rib structures that partially or fully encircle one or more connection arrangements can have generally the same shape, size, configuration, and/or composition, and also optionally be positioned at the same distance from the sides of the improved plate system. In another non-limiting embodiment, the rib structure can be shaped to form a full or partial box shape or full or partially trapezoidal shape on the bottom side of the improved plate system. Such box shaped or trapezoidal shaped rib structures can optionally be centrally positioned about the latitudinal central axis of the improved plate system.

In another and/or alternative non-limiting aspect of the present disclosure, the method for using the improved plate system includes the steps of using adhesive to partially or fully secure the improved plate system to the concrete surface. Many different types of adhesives can be used. Generally, the adhesive is an epoxy adhesive; however, other or additional adhesives can be used. When an epoxy adhesive is used, the epoxy is generally a two-part, 100% solids epoxy that is thixotropic in nature. However, other adhesives that include vinyl ester resins, polyester resins, acrylic resins, polyurethane resins, phenolic resins, alkyd resins, polycarbonate resins, polyamide resins, and/or silicone resins can also or alternatively be used. The curing time for the adhesive is generally about 1-5 hours, depending on the temperature. The bonding strength of the improved composite material to the concrete is at least about 1 KSI. In one embodiment of the disclosure, bonding strength of the adhesive to the concrete is 1-6 KSI (and all values and ranges therebetween). In another one non-limiting aspect of this embodiment, the bonding strength of the adhesive to the concrete is at least about 1.5 KSI. In another non-limiting aspect of this embodiment, the bonding strength of the adhesive to the concrete is at least about 1.8 KSI. In another non-limiting aspect of this embodiment, the bonding strength of the adhesive to the concrete is at least about 2 KSI. In another non-limiting aspect of this embodiment, the bonding strength of the adhesive to the concrete is about 2-5 KSI. In another non-limiting aspect of this embodiment, the bonding strength of the adhesive to the concrete is about 2.2-4 KSI. In another non-limiting aspect of this embodiment, the bonding strength of the adhesive to the concrete is about 2.4-3.2 KSI. As can be appreciated, one or more other connection arrangement can be used in combination with the adhesive to secure the improved plate system to the concrete surface (e.g., bolts, clips, rod, pin, screw, cord, bolt, etc.).

In another and/or alternative non-limiting aspect of the present disclosure, the method for using the improved plate system includes the steps of 1) optionally cleaning the bottom surface of the concrete surface, 2) attaching one or more anchors (e.g., bolts, clips, rod, pin, screw, cord, chain, etc.) to the bottom surface of the concrete surface, and 3) securing the connection arrangement on the improved plate system (e.g., position bolt end through holes in the improved plate system and then thread nuts on the bolts, etc.) to secure the improved plate system to the bottom surface of the concrete sections. The method can optionally further include the step of using an adhesive to facilitate in securing the improved plate system to the concrete. The method can optionally include removing one or more removable layers, removable sections, or shims from the top surface of the base plate or from above the top surface of the base plate of the improved plate section prior to securing the improved plate system to the concrete so as to account for unevenness in the two sections of the concrete to be repaired.

The improved plate section has several advantages, namely:

- No cuts in the top of concrete deck is required;
- No adhesive is required to secure the improved plate system to the concrete;
- The improved plate system can optionally include one or more removable layers, removable sections, or shims to secure the improved plate system to concrete sections that are not evenly aligned;
- The improved plate system is lighter than steel angle iron connectors, thus easier to install;
- The improved plate system can use anchor bolts to partially or fully secure the improved plate system to the concrete sections, and does not require through bolts as required for steel angle iron connectors;
- The improved plate system is more aesthetically pleasing than a steel angle iron connector that is prone to rusting; and
- Stainless steel anchor bolts can be used to partially or fully secure the improved plate system to the concrete sections to be repaired and the use of stainless-steel anchor bolts reduces rust and corrosion.

It is one non-limiting object of the present disclosure to provide a method and apparatus for repairing and/or connecting concrete that is not as labor intensive as previous repair systems.

It is another and/or alternative non-limiting object of the present disclosure to provide a method and apparatus for repairing and/or connecting concrete that will not corrode and/or reduce the amount of corrosion over time.

It is another and/or alternative non-limiting object of the present disclosure to provide a method and apparatus for repairing and/or connecting concrete that reduces the incidence of cracking at or near the concrete connection location.

It is another and/or alternative non-limiting object of the present disclosure to provide a method and apparatus for repairing and/or connecting concrete that includes the use of an improved plate system that includes less than 50 wt. % metal.

It is another and/or alternative non-limiting object of the present disclosure to provide a method and apparatus for repairing concrete that minimizes the risk of damaging pre-existing concrete during the repair process.

It is another and/or alternative non-limiting object of the present disclosure to provide a method and apparatus for repairing and/or connecting two adjacent pre-existing sections of concrete using an improved plate system that is connected to the underside of the concrete sections.

It is another and/or alternative non-limiting object of the present disclosure to provide a method and apparatus for repairing and/or connecting two adjacent pre-existing sections of concrete using an improved plate system that is connected to the underside of the concrete sections and wherein the improved plate system includes one or more reinforcement structures.

These and other objects and advantages will become apparent to those skilled in the art upon reading and following the description taken together with the accompanying drawings.

BRIEF DESCRIPTION OF THE DRAWINGS

Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, the shapes of various elements are selected, enlarged, and positioned to improve drawing legibility. The particular shapes of the elements as drawn have been selected for ease of recognition in the drawings. Reference may now be made to the drawings, which illustrate various embodiments that the disclosure may take in physical form and in certain parts and arrangement of parts wherein.

DETAILED DESCRIPTION OF NON-LIMITING EMBODIMENTS

Figure 1:
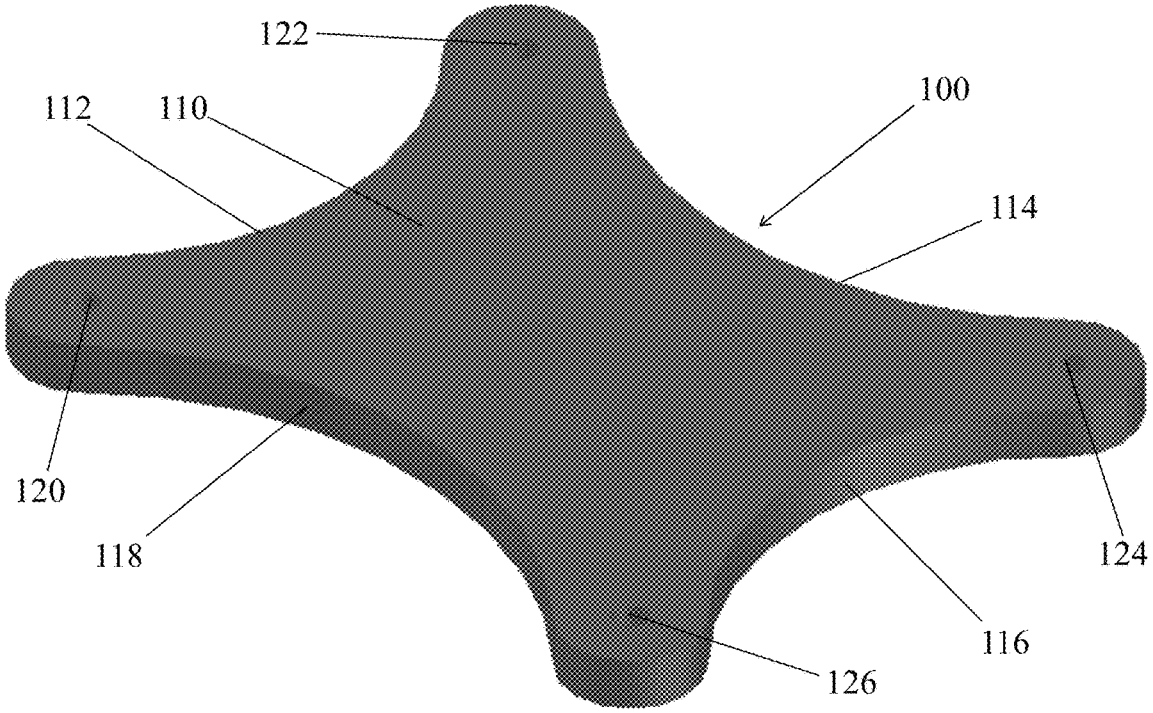
FIG. 1 is an isometric view of a non-limiting improved plate system in accordance with the present disclosure wherein the base plate has four sides and each side has an inwardly curved profile.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

For the sake of simplicity, the attached figures may not show the various ways (readily discernable, based on this disclosure, by one of ordinary skill in the art) in which the disclosed system, method and apparatus can be used in combination with other systems, methods and apparatuses. Additionally, the description sometimes uses terms such as "produce" and "provide" to describe the disclosed method. These terms are abstractions of the actual operations that can be performed. The actual operations that correspond to these terms can vary depending on the particular implementation and are, based on this disclosure, readily discernible by one of ordinary skill in the art.

Referring now to the drawings wherein the showings are for the purpose of illustrating non-limiting embodiments of the disclosure only and not for the purpose of limiting same, FIGS. 1-19 illustrate various non-limiting embodiments of the improved plate system in accordance with the present disclosure.

FIGS. 1-5 illustrate one non-limiting shape of the improved plate system. FIGS. 6-15 illustrate another non-limiting shape (e.g., rectangular shape) of the improved plate system. As can be appreciated, other shapes for the improved plate system can be used (e.g., square, oval, polygonal, etc.).

Figure 2:
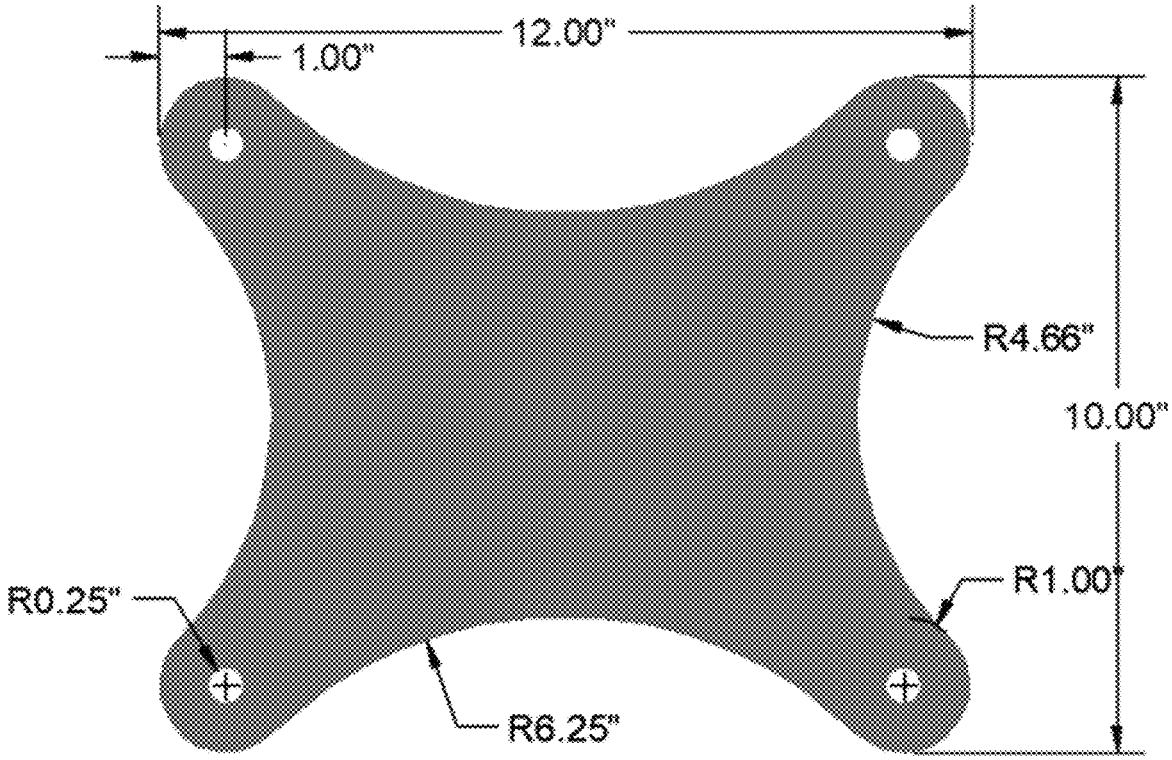
FIG. 2 is a top plan view of the improved plate system of FIG. 1 that includes non-limiting dimensions of the base plate.

Referring now to FIGS. 1-2, there is illustrated an improved plate system 100 that is formed of a plate body 110. Generally the plate body is formed of a single piece. In the non-limiting configuration illustrated in FIGS. 1-2, the plate body fully constitutes the improved plate system 100. The plate body includes four sides 112, 114, 116, 118, and each of the sides has an inward curved profile. The four corners 120, 122, 124, 126 are illustrated as being rounded. Each of the four corners includes a single connection arrangement in the form of a hole 130, 132, 134, 136 that passes fully through the thickness of the plate body 110. The connections arrangements are illustrated as being spaced from the peripheral edge of the plate body. As illustrated in FIG. 2, the cross-sectional shape of the connection arrangement is circular and the cross-sectional shape and size is constant through the thickness of the plate body; however, this is not required. As can be appreciated, the cross-sectional shape of the connection arrangement can have other shapes (e.g., oval, square, triangular, rectangular, polygonal, etc.), and the cross-sectional shape and/or size can vary along the thickness of the plate body. The length and shape of sides 112, 116 are the same, and the length and shape of sides 114, 118 are the same; however, this is not required. FIG. 2 illustrates non-limiting dimensions of the sides of the plate body 110. Generally, the longitudinal length of the plate body is greater than the lateral length (e.g., the length of the plate body that is perpendicular to the longitudinal axis of the plate body); however, this is not required. The thickness of the plate body is illustrated as being uniform; however, this is not required. Generally, the thickness of the plate body is 0.1-4 inches (and all values and ranges therebetween), and typically 0.2-2 inches.

The material that is used to form the plate body generally is formed of less than 20 wt. % metal, and typically 0-5 wt. % metal, and more typically 0-1 wt. % metal. In one-non-limiting configuration, the body is formed of a plurality of non-metal fibers (e.g., carbon fibers, glass fibers, aramid fibers [Kevlar™, Twaron™, etc.], boron fibers, hemp fibers, basalt fibers, nylon fibers, Dyneema™ fibers, Zylon™ fibers, fiberglass fibers, etc.) that are bonded together by an adhesive or polymer material (e.g., resin, etc.).

Figure 3:
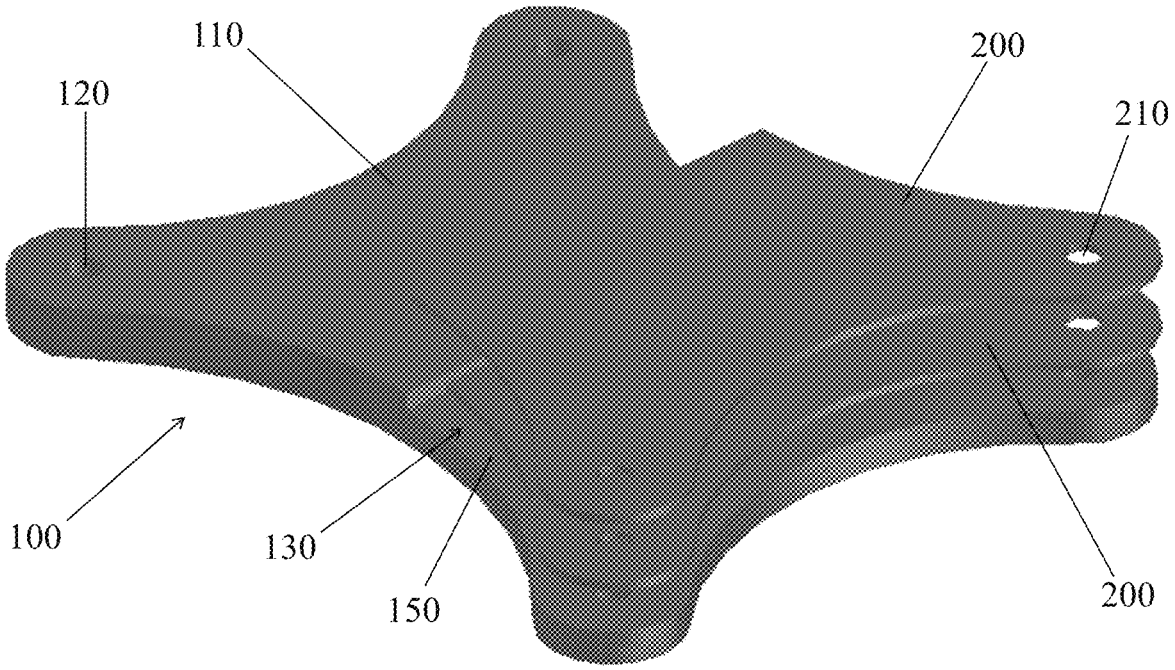
FIG. 3 is an isometric view of the improved plate system of FIG. 1 wherein the improved plate system includes a plurality of removable layers or removable sections or shims on the top side of the improved plate system.
Figure 11:
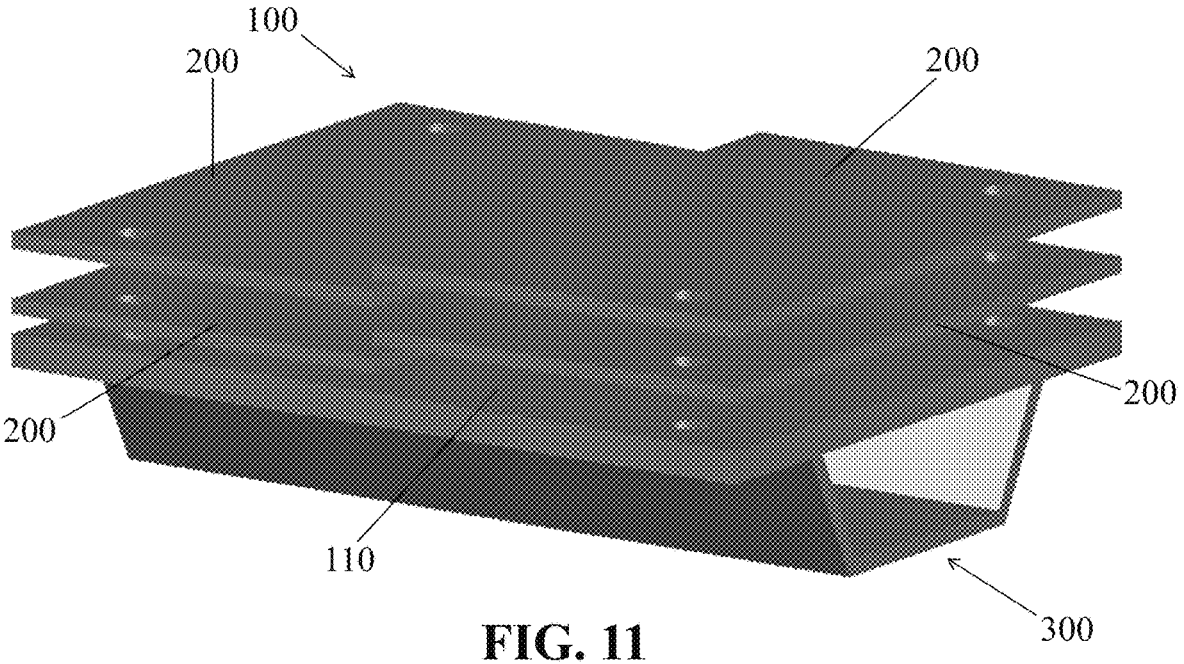
FIG. 11 is an isometric view of the improved plate system of FIG. 9, and wherein the improved plate system includes a plurality of removable layers or removable sections or shims on the top side of the improved plate system.
Figure 12:
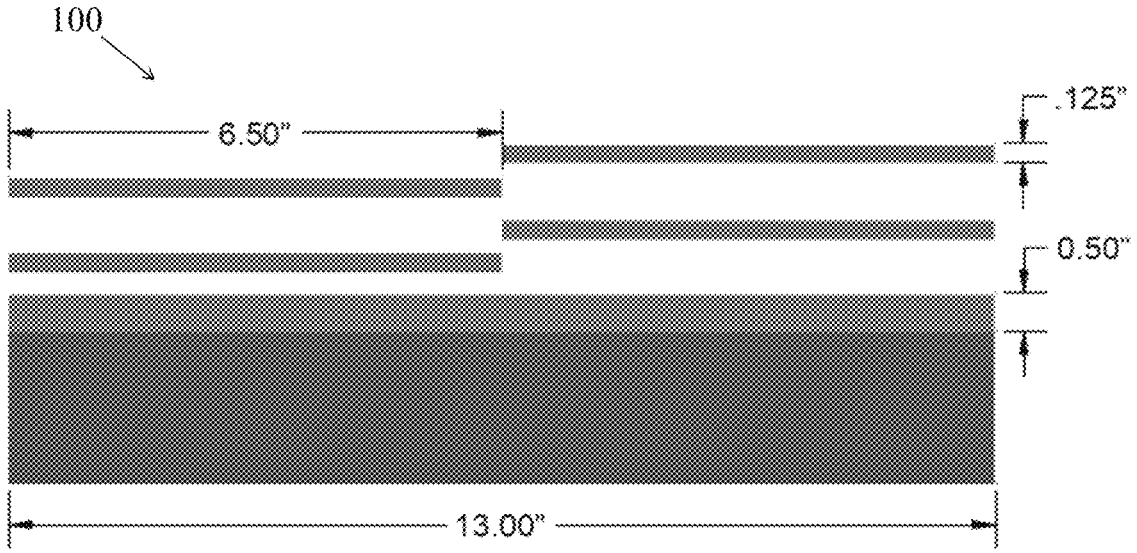
FIG. 12 is side view of FIG. 11, and wherein non-limiting dimensions of the base plate and removable layers or removable sections or shims are shown.
Figure 13:
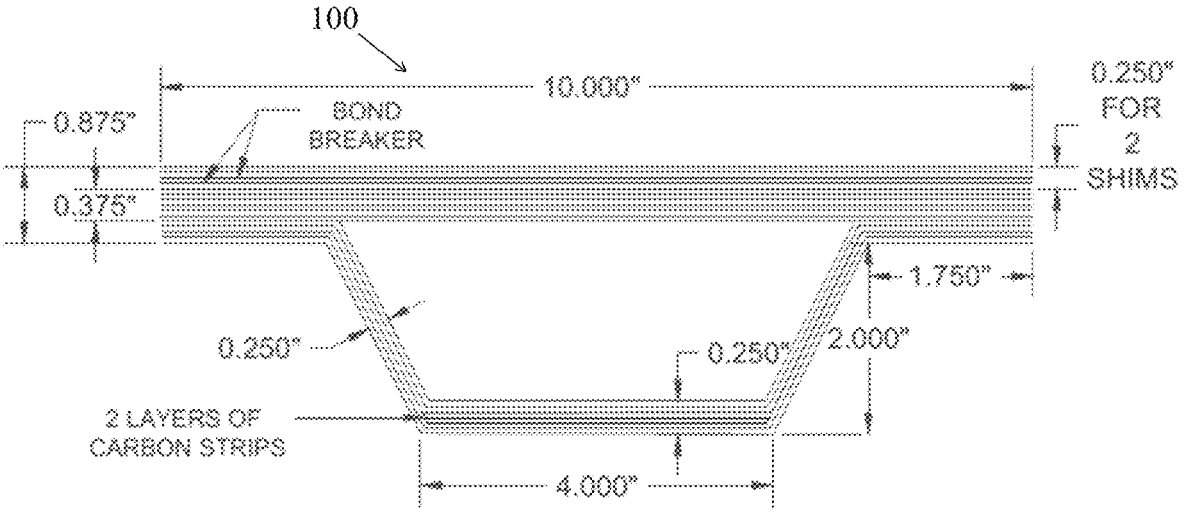
FIG. 13 is another side view of FIG. 11 wherein the removable layers or removable sections or shims are not separated from the base plate, and wherein non-limiting dimensions of the base plate and removable layers or removable sections or shims are shown, and wherein the bond breaker layer is illustrated.

Referring now to FIG. 3, there is illustrated one variation of the improved plate system 100 of FIG. 1 that includes one or more removable layers, removable sections, or shims 200 can be removably connected to the top surface 130 of plate body 110. FIGS. 11-13 also illustrated additional variations of the improved plate system that can include one or more shims. The thickness of the shims 200 is generally less than the maximum thickness of the plate body. In one non-limiting configuration, the thickness of the shims is 0.5-3 inches (and all values and ranges therebetween), and typically 0.101.5 inches.

The top surface of the shims 200 generally have a cross-sectional area that is less than a cross-sectional area of the top surface of the plate body 110 (e.g., the top surface of each of the shims has a cross-sectional area that is 5-80% (and all values and ranges therebetween) of the cross-sectional area of the top surface of the plate body). As illustrated in FIG. 3, the top surface of each of shims 200 has a cross-sectional area that is about 50% the cross-sectional area of the top surface of the plate body 110. As also illustrated in FIG. 3, the shim is located only on one side the central latitudinal axis of the plate body. The shape of the top and bottom surface of the shim is generally the same shape as the top surface of the plate body 110 that the shim overlies. Each of the shims 200 includes an opening 210 that is the same shape and size of the opening in the plate body 110 that the hole overlies, and the opening is positioned on the shim such that when the shim is positioned on the plate body, the central axis of the holes in the shim and plate body are aligned; however, this is not required.

The top surface of the plate body that is configured to receive the one or more shims includes a recessed region 150 as illustrated in FIG. 3 such that when shims are placed on the top surface of the plate body, the top surface of the shim is generally flush with the top surface of the plate body that is absent the shims. The shape of the recessed region is generally the same or similar to the shape of the shim. When the improved plate system includes only a single shim, the depth of the recessed region is generally the same as the thickness of the shim; however, this is not required. When the improved plate system includes two or more shims that are stacked upon one another, the depth of the recessed region is generally the same as the thickness of the stacked shims; however, this is not required. The material that is use to form the plate body is generally the same material that is used to form the shims; however, this is not required.

FIG. 3 illustrated that the shims are only positioned on one side of the improved plate system; however, it will be appreciated that the shims can be located on both sides of the improved plate system as illustrated in FIGS. 11-12. When the shims are located on both sides of the improved plate system, a) the number of shims on each side can be the same or different, b) the thickness of the shims can be the same or different, and/or c) the shape of the shims can be the same or different.

Figure 4:
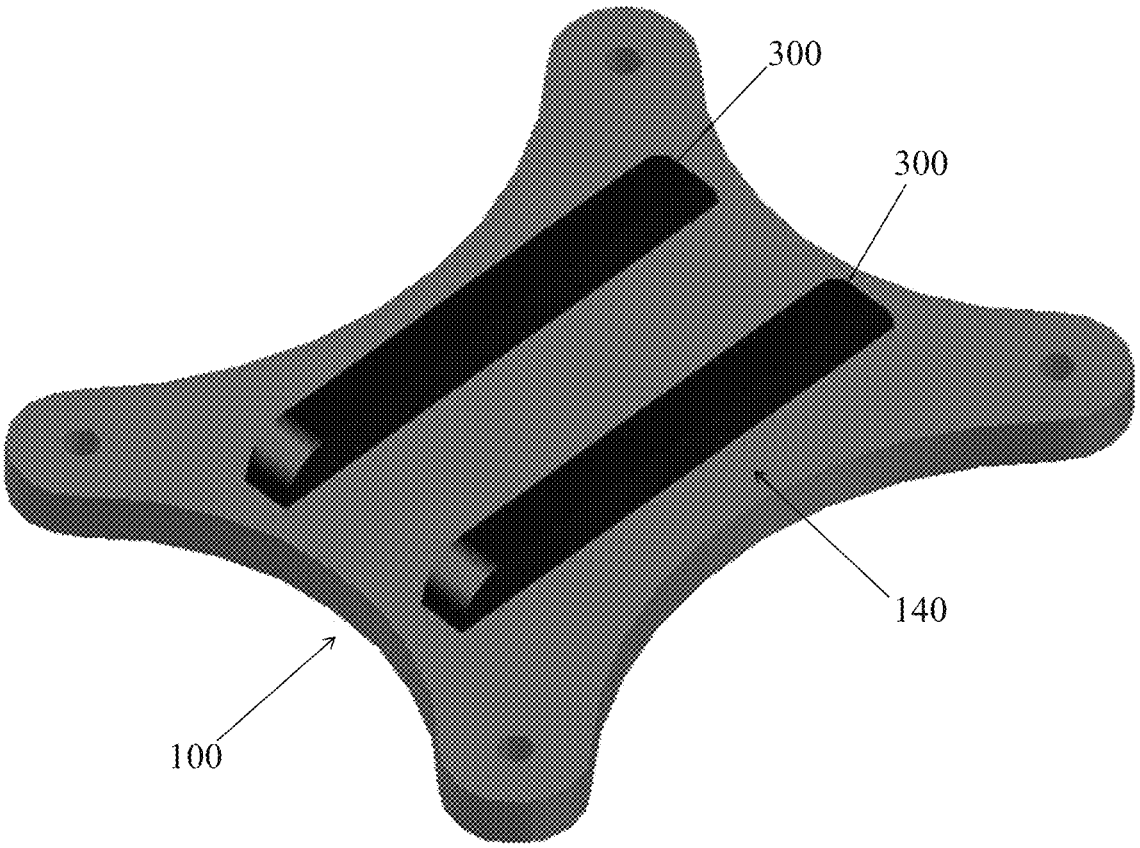
FIG. 4 is an isometric view of the improved plate system of FIG. 1 wherein the bottom side of the improved plate system includes a plurality of linear shaped reinforcement structures, and wherein both reinforcement structure are positioned parallel to a central longitudinal axis of the improved plate system and one reinforcement structure is located on each side of the central longitudinal axis of the improved plate system.

Referring now to FIG. 4, there is illustrated a plate body 110 that includes two reinforcement structures 300 on the bottom surface 140 of the plate body 110. As can be appreciated, the bottom surface 140 of the plate body 110 of FIGS. 1-3 can optionally includes one or more reinforcement structures 300. The shape and size of the reinforcement structures and the number of reinforcement structures is non-limiting. FIGS. 4, 5, and 7-19 illustrated several non-limiting reinforcement structures and non-limiting positioning of the reinforcement structures on the bottom surface of the plate body. The material used to form the reinforcement structures can the same or different material from the material used to form the plate body or the one or more optional shims. In one non-limiting configuration, the reinforcement structures are uniformly formed with the plate body, and the plate body and the reinforcement structures are formed of the same material. The thickness/height of one or more reinforcement structures can be less than, equal to or greater than a thickness of the plate body. The reinforcement structures are configured to add strength and/or rigidity to the improved plate system. Generally, the one or more reinforcement structures are formed on the plate body so as to create a single piece structure, and wherein the one or more reinforcement structures are irremovable secured to the plate body.

As illustrated in FIG. 4, the bottom surface of the plate body includes two reinforcement structures 300 that are positioned generally parallel to one another and are equally spaced apart along the longitudinal central axis of the plate body, and are both spaced for the longitudinal central axis of the plate body. The two reinforcement structures are generally linear shaped and have a longitudinal length that is less than a longitudinal length of the plate body. The end portions of the two reinforcement structures are curved; however, this is not required. The shape and size of the two reinforcement structures is generally the same; however, this is not required. The thickness/height of reinforcement structures can optionally be equal to or greater than the thickness of the plate body.

Figure 5:
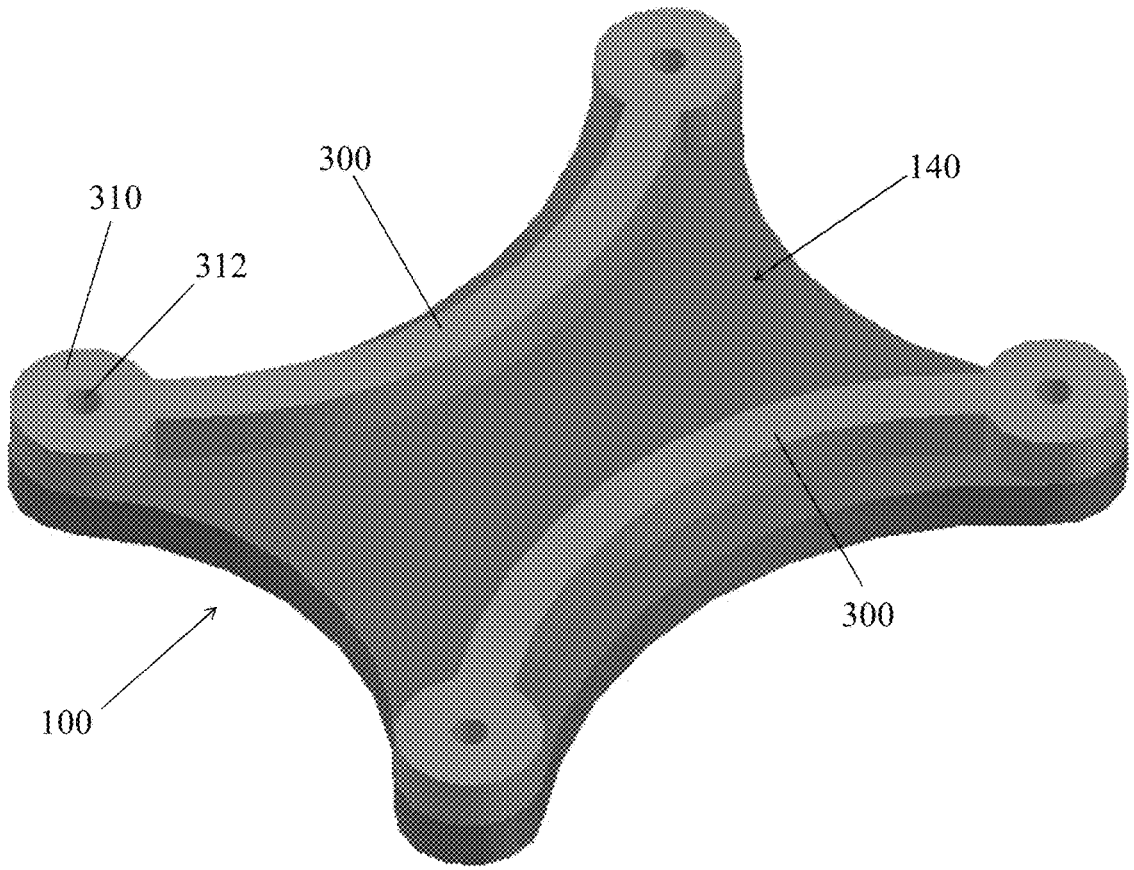
FIG. 5 is an isometric view of the improved plate system of FIG. 1 wherein the bottom side improved plate system includes a plurality of curved shaped reinforcement structures, and wherein both reinforcement structure are positioned parallel to a central longitudinal axis of the improved plate system and one reinforcement structure is located on each side of the central longitudinal axis of the improved plate system.

Referring now to FIG. 5, the two reinforcement structures 300 have a generally curved shape that are both spaced for the longitudinal central axis of the plate body. The radius of curvature of the reinforcement structures can be the same or similar to the radius of curvature of the sides of the plate body such that the spacing of the reinforcement structure form the peripheral edge of the plate body is generally constant; however, this is not required. The thickness/height of reinforcement structures can optionally be equal to or greater than the thickness of the plate body. Positioned about the connections arrangements are reinforcement structures 310. The reinforcement structures have an opening 312 that is aligned with the connection arrangements. Generally, the shape of openings 312 is the same as the connection arrangement in the plate body; however, this is not required. As illustrated in FIG. 5, the reinforcement structures do not extend beyond the perimeter of the plate body; however, this is not required. The thickness/height of the reinforcement structures can be the same or different (e.g., thinner or thicker) from the thickness of the plate body.

Figure 6:
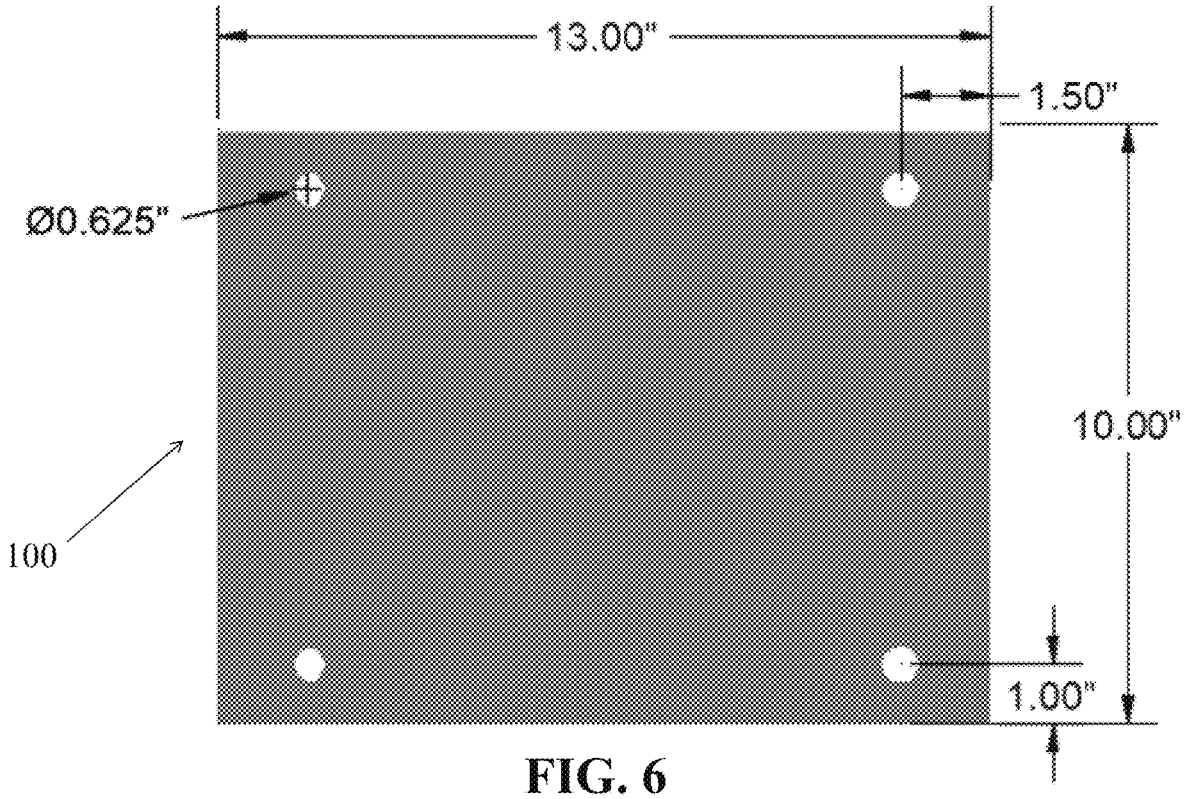
FIG. 6 is a top plan view of another non-limiting improved plate system that has a base plate having a square or rectangular shape, and wherein non-limiting dimensions of the base plate are shown.

Referring now to FIG. 6, the shape of the plate body is illustrated as being generally square or rectangular shaped. FIG. 6 illustrates non-limiting dimensions of the plate body. The structures discussed in FIGS. 3-5 can be used with the plate body illustrated in FIG. 6. Likewise, the structures illustrated in FIGS. 7-19 can be used with the plate body of FIGS. 1-5.

As illustrated in FIG. 6, the longitudinal length of the plate body is greater than the lateral length of the plate body; however, this is not required. The four connection arrangements are spaced from the peripheral edge of the plate body. It can be appreciated that the plate body can include less than four connection arrangement (e.g., 2 or 3 connection arrangements) or more than four connection arrangements (e.g., 5-20 connection arrangement and all values and ranges therebetween). As illustrated in FIG. 6, the cross-sectional shape of the connection arrangement is circular and the cross-sectional shape and size is constant through the thickness of the plate body; however, this is not required. As can be appreciated, the cross-sectional shape of the connection arrangement can have other shapes (e.g., oval, square, triangular, rectangular, polygonal, etc.), and the cross-sectional shape and/or size can vary along the thickness of the plate body. In the non-limiting configuration illustrated in FIG. 6, the plate body fully constitutes the improved plate system 100.

Figure 7:
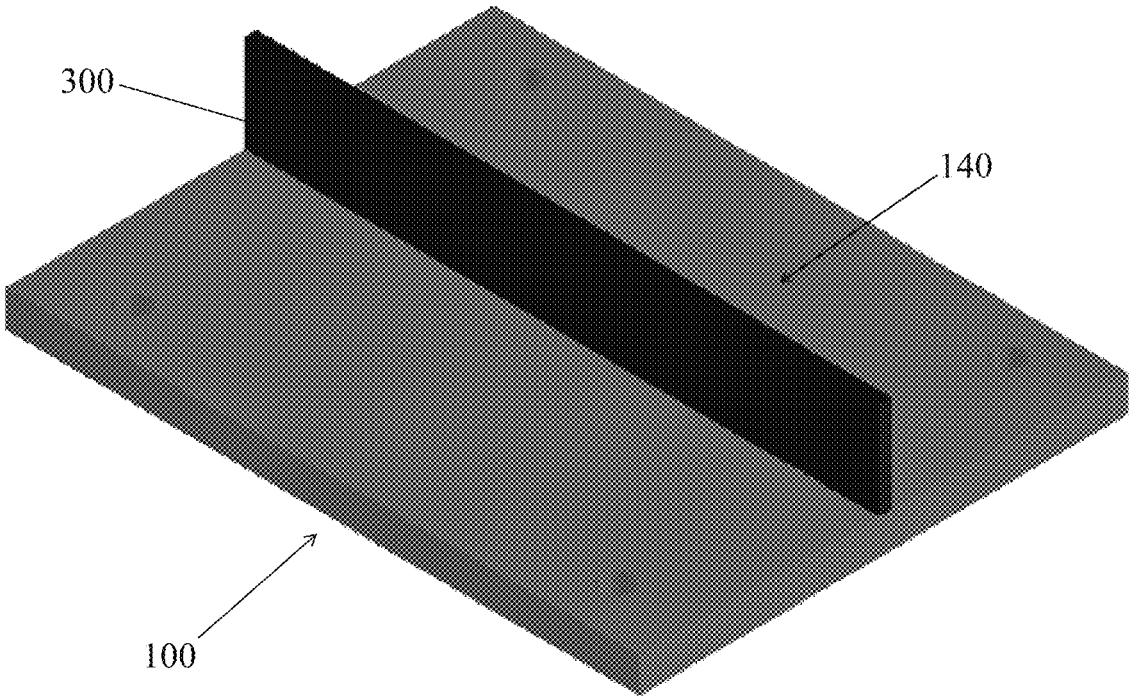
FIG. 7 is an isometric view of the improved plate system of FIG. 6 wherein the bottom side of the improved plate system includes a single reinforcement structure that is positioned along the central longitudinal axis of the improved plate system.
Figure 8:
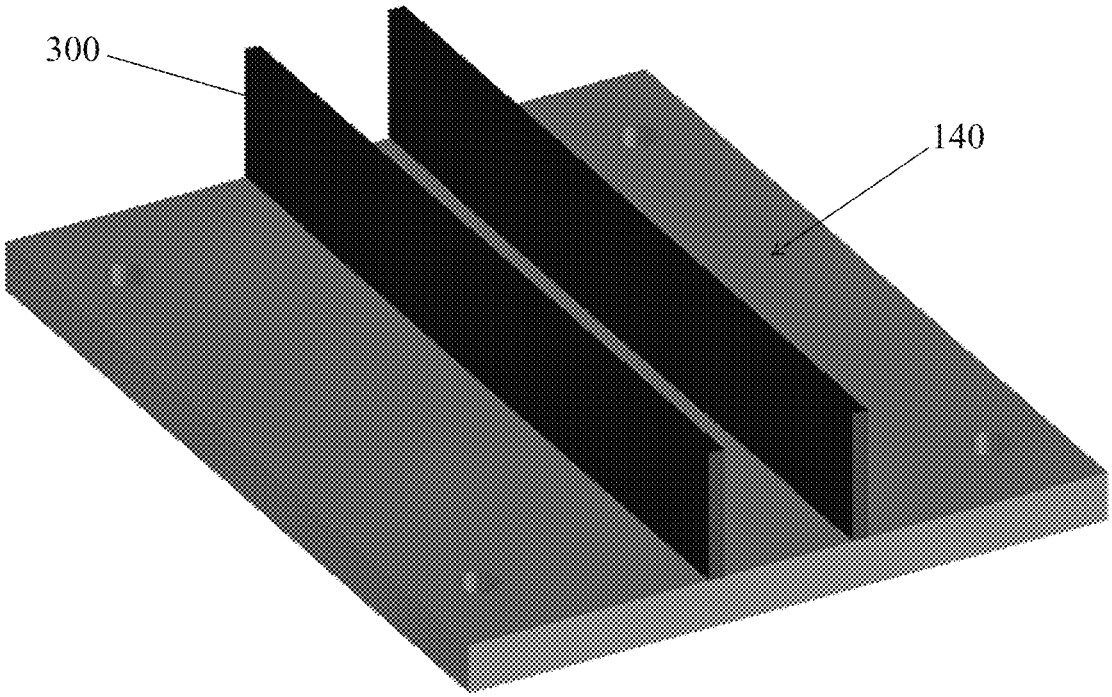
FIG. 8 is an isometric view of the improved plate system of FIG. 6 wherein the bottom side of the improved plate system includes a plurality of reinforcement structures and one reinforcement structure is located on each side of the central longitudinal axis of the improved plate system.

Referring now to FIGS. 7 and 8, the bottom surface of the plate body 110 includes different numbered and positioned reinforcement structures 300. FIG. 7 illustrate a single linear shaped reinforcement structure positioned along the longitudinal central axis of the plate body. The thickness/height of reinforcement structure can optionally be equal to or greater than the thickness of the plate body. FIG. 8 illustrates two linear shaped reinforcement structures positioned parallel to one another and parallel to and spaced from the longitudinal central axis of the plate body. The thickness/height of reinforcement structures can optionally be equal to or greater than the thickness of the plate body.

Figure 9:
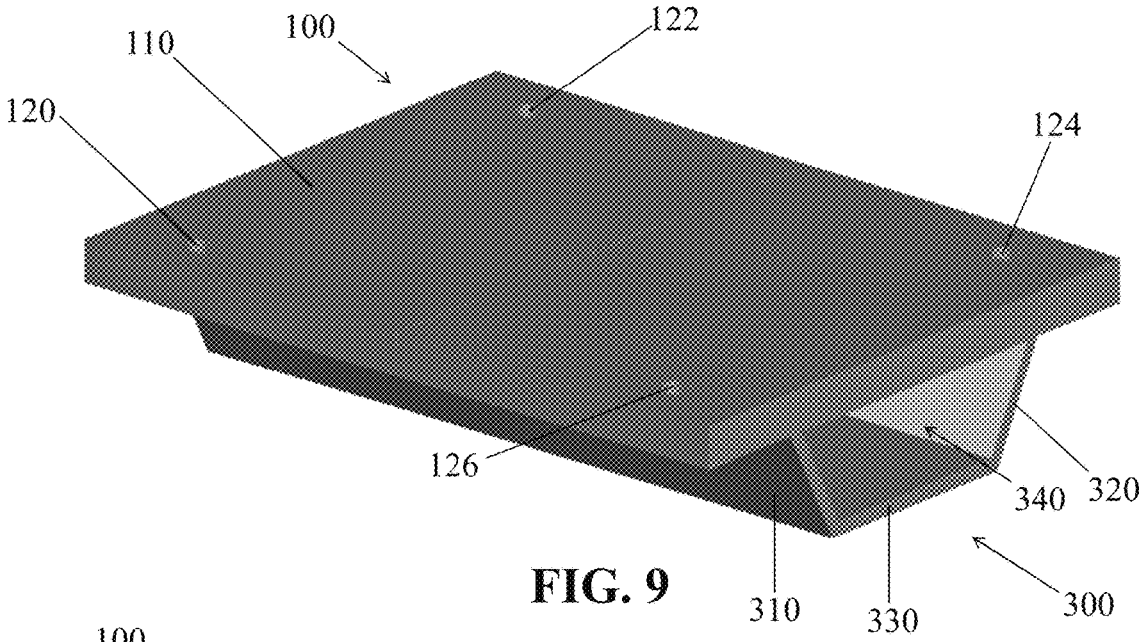
FIG. 9 is an isometric view of another non-limiting improved plate system in accordance with the present disclosure wherein the base plate is square or rectangular shaped and includes a semi-trapezoidal shaped reinforcement structure on the bottom side of the improved plate system that is positioned along the central longitudinal axis of the improved plate system.

Referring now to FIGS. 9-15, there is illustrated another non-limiting improved plate system 100. The plate body 110 is similar in shape to the plate body 110 illustrated in FIGS. 6-8. The reinforcement structure 300 has a generally semi-trapezoidal shape that includes two side sections 310, 320 that slope downwardly and toward on another and a base section 330 that is connected to the bottom ends of the two side sections. The size and angle of slope of the two side sections is illustrated as being the same; however, this is not required. The bottom surface of the base section is illustrated as being generally parallel to the bottom surface and/or top surface of the plate body; however, this is not required. As illustrated in FIG. 9, the location of each of the connection arrangements in the base plate is closer to the peripheral edge of the base plate than the location of the top end of the side sections to the peripheral edge of the base plate.

Figure 10:
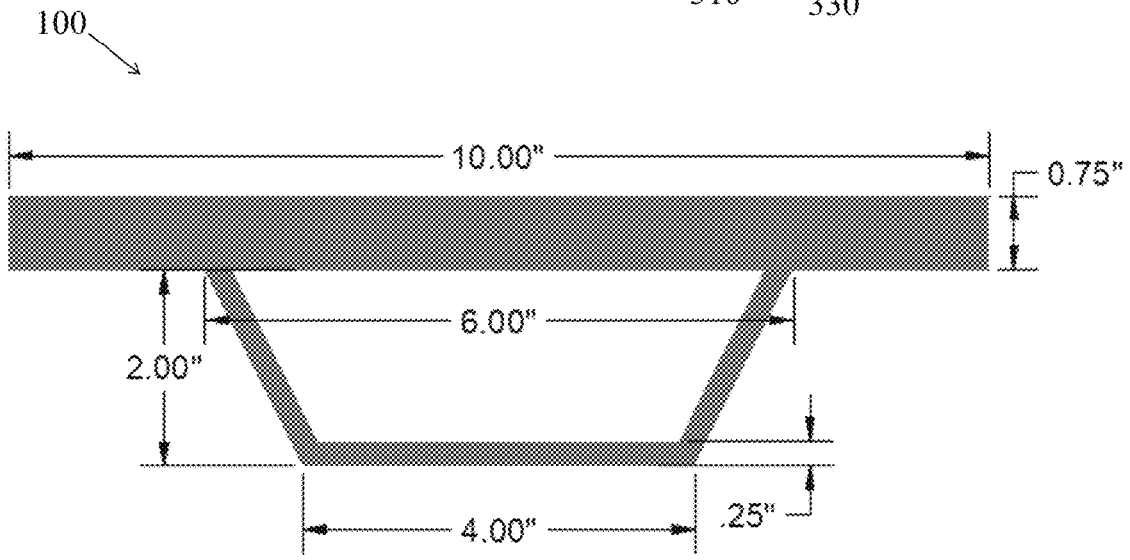
FIG. 10 is an end view of the improved plate system of FIG. 9, and wherein non-limiting dimensions of the base plate are shown.

FIG. 10 illustrates non-limiting dimensions for the components of the reinforcement structure 300. The two side sections and base section are illustrated as having the same thickness; however, this is not required. The reinforcement structure is illustrated as having a longitudinal length of 80-100% (and all values and ranges therebetween) of the longitudinal length of the plate body. The width of the reinforcement structure is illustrated as being less than a width of the plate body such that the upper ends of the two side sections are spaced from the peripheral edge of the plate body. Generally, the maximum width of the reinforcement structure is 30-100% (and all values and ranges therebetween) the maximum width of the plate body. As illustrated in FIG. 10, the maximum width of the reinforcement structure is about 60% the maximum width of the plate body. In one non-limiting configuration, the reinforcement structure is uniformly formed with the plate body and the plate body and the reinforcement structure are formed of the same material. The height/depth of the reinforcement structure is illustrated as being greater than a thickness of the plate body (e.g., 1.1-10 times greater and all values and ranges therebetween); however, this is not required. As illustrated in FIG. 10, height/depth of the reinforcement structure is over 2 times the thickness of the plate body. The shape of the reinforcement structure forms a cavity 340 through the reinforcement structure along the longitudinal length the reinforcement structure. The cross-sectional shape and size of the cavity 340 can be generally constant along the longitudinal length of the cavity; however, this is not required. The thickness of the plate body is illustrated as being greater than the thickness of the two side sections and base section of the reinforcement structure (e.g., 1.1-10 times greater and all values and ranges therebetween); however, this is not required. As illustrate in FIG. 6, thickness of the plate body is three times the thickness of each of the two side sections and base section of the reinforcement structure.

Referring now to FIGS. 11 and 12, the improved plate system 100 optionally includes one or more removable layers, removable sections, or shims 200 that can be removably connected to the top surface 130 of plate body 110. FIG. 12 illustrates non-limiting dimension of the shims and base plate. As illustrated in FIG. 12, the thickness of the plate body is greater than a thickness of each of the shims (e.g., plate body is 1.1-10 times the thickness of each shim and all values and ranges therebetween).

As illustrated in FIG. 11, the shims are located on both sides of the longitudinal central axis of the plate body. As can be appreciated, the shims can be located only on one side of the longitudinal central axis of the plate body. FIG. 11 also illustrates that two shims are located on each side of the longitudinal central axis of the plate body. As can be appreciated, less than two or more than two shims can be located on only one side or on both sides of the longitudinal central axis of the plate body. In use, the same number of shims can be removed from each side of the longitudinal central axis of the plate body, or a different number of shims can be removed from each side of the longitudinal central axis of the plate body. The connection arrangements (e.g., openings or holes, etc.) in the shims are configured to align with the connection arrangement in the plate body when the shims are positioned on or above the top surface of the plate body. The connection arrangement in the shims and the connection arrangements in the plate body generally have the same shape and size; however, this is not required.

Referring now to FIG. 13, there is illustrated an improved plate system wherein the plate body and the reinforcement structure are formed of multiple layers (e.g., 2-10 layers and all values and ranges therebetween) of fiber material (e.g., carbon fibers, etc.). In one non-limiting configuration, the reinforcement structure is formed of at least two layers of fiber material, and the plate body is formed of at least three layers of fiber material. Each of the shims is formed of a single layer of fiber material. In the non-limiting example illustrated in FIG. 13, there are shims that are stack on one another. The top shim is removable connected to the bottom shim and the bottom shim is removable connect to the top surface of the plate body. Such removable connection is formed by a breakable bond layer (e.g., weak adhesive bond, brittle adhesive bond, bond breaker layer [e.g., polyurethane, silicone, etc.], breakable tape, breakable fabric mesh, etc.). The breakable layer allows a user to remove one or more shims from one or both sides of the improved plate system with damaging the plate body or any shims that are not removed from the improved plate system. Generally, the thickness of the breakable layer is less than a thickness of each of shims; however, this is not required. As illustrated in FIG. 13, a breakable layer is positioned between the upper and lower shim and also between the lower shim and the top surface of the plate body. The breakable layer is generally formed of a different composition from the adhesive or polymer material used to bond together the fiber layers of the plate body, shims and the reinforcement structure.

Referring again to FIG. 13, the reinforcement structure, the plate body, and/or one or more of the shims can optionally include one or more fiber layers that are formed of a different material (e.g. fiberglass, etc.). Such different layer can be used to partially or fully form a) the breakable bond layer and/or b) form a dielectric insulating layer. In one non-limiting configuration, the different layer is formed of one or more fiberglass layers. In another non-limiting configuration, the different layer can be positioned on the top and/or bottom surface of the improved plate system.

Figure 14:
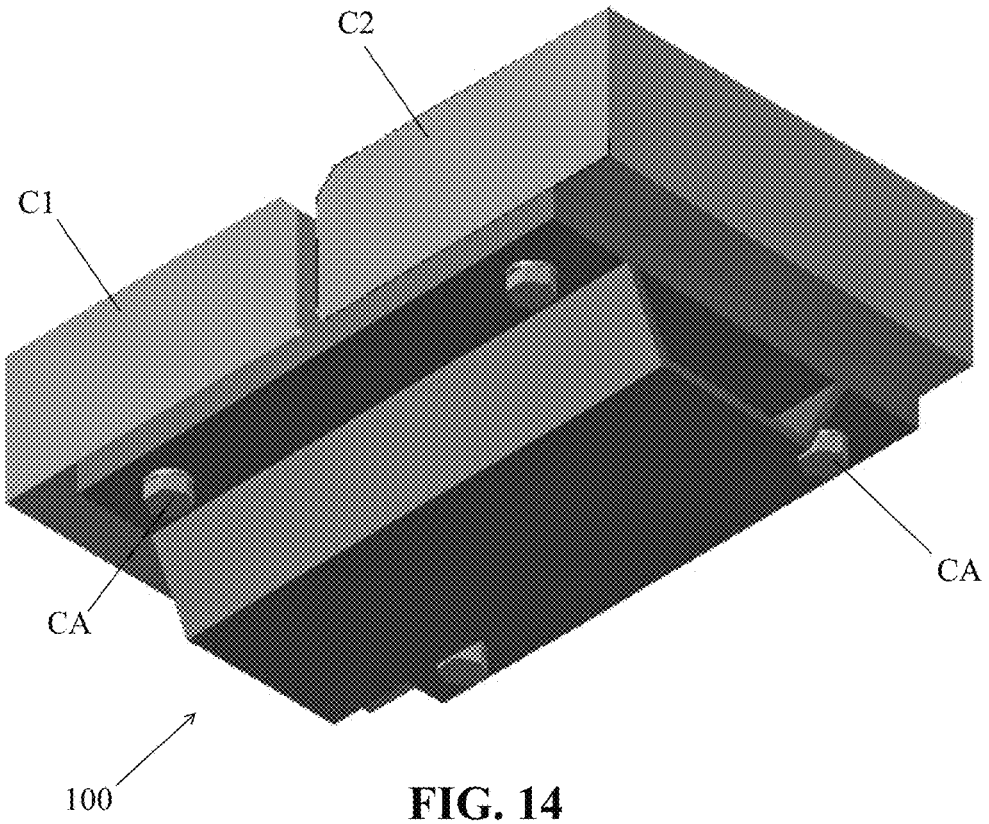
FIG. 14 is an isometric view of the improved plate system of FIG. 9 that is connected to two concrete sections.
Figure 15:
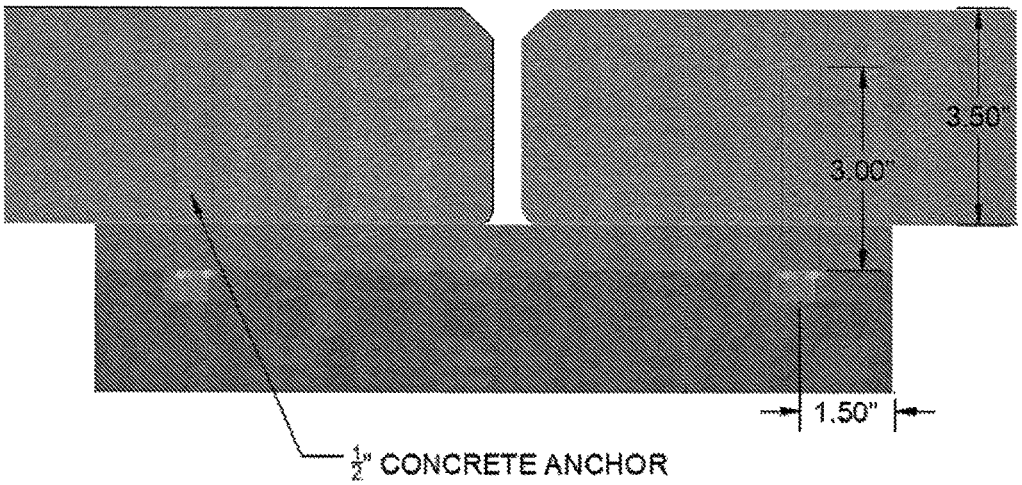
FIG. 15 is a sectional side view of FIG. 14 that illustrates the use of a non-limiting type of concrete anchor that can be used to secure the improved plate system to the two concrete sections.

Referring now to FIGS. 14-15, there is illustrated the improved plate system similar to the one illustrated in FIGS. 9-13 that is connected to two sections of concrete C1, C2 by the use of concrete anchors CA wherein one end portion is of each of the concrete anchors is partially positioned in each of the connection arrangements of the improved plate system, and the other end portion of each of the concrete anchors is secured to one of the two sections of concrete. As can be appreciated, the other improved plate systems illustrated in FIGS. 1-8 can be similarly connected to the two sections of concrete C1, C2 by the use of concrete anchors CA.

Figure 20:
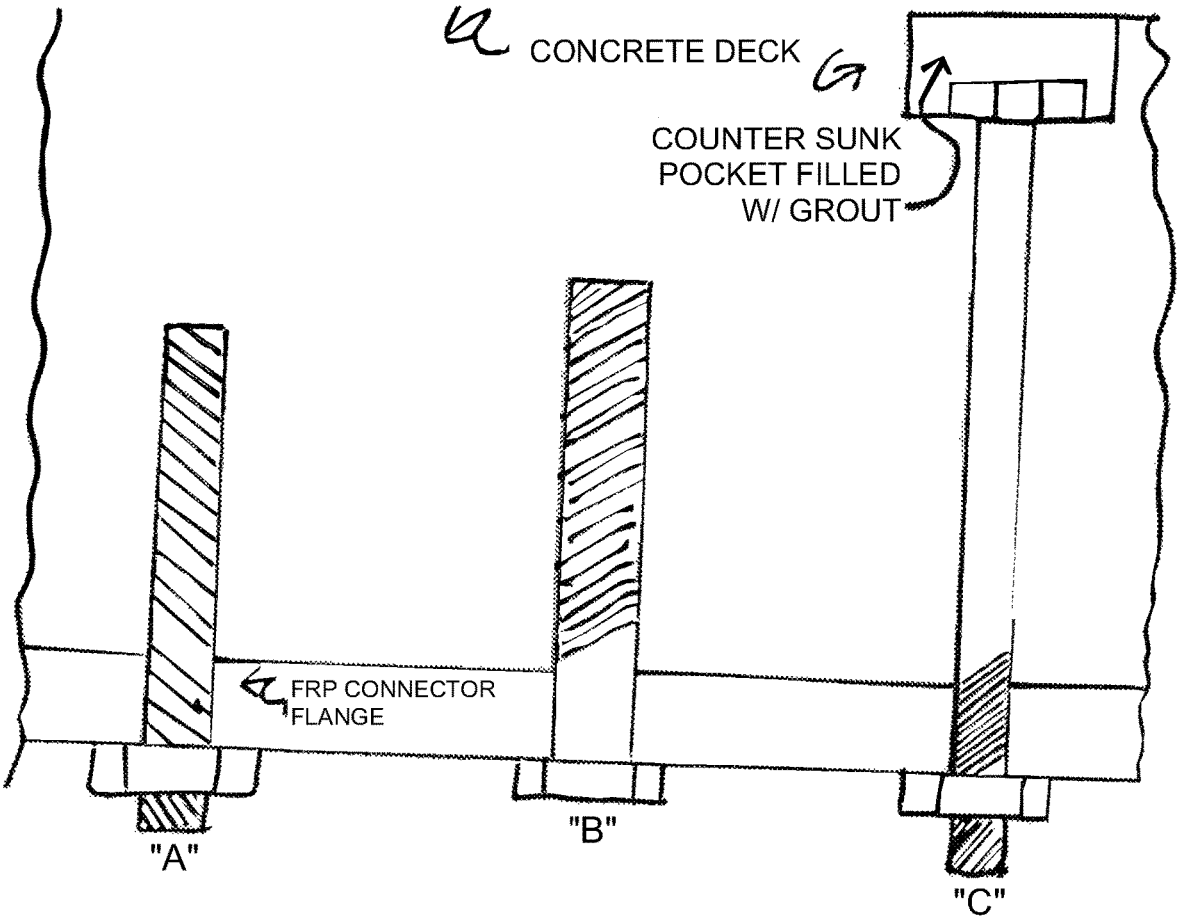
FIG. 20 illustrates three non-limiting types of concrete anchor that can be used to secure the improved plate system to the two concrete sections.

FIG. 15 illustrates non-limiting dimensions of the concrete anchors CA that can be used to secure the improved plate system to the two sections of concrete C1, C2. Referring now to FIG. 20, there are illustrated other non-limiting types of concrete anchors CA that can be used to secure the improved plate system to the two sections of concrete C1, C2. The Type A concrete anchor CA is a pin that at least includes threading at the end for connection with a bolt. The pin is inserted into a drilled opening in the concrete and thereafter secured on the drilled opening by use of an adhesive, expansion structure, wedge, etc. The Type B concrete anchor CA is a screw that is screwed into a predrilled opening in the concrete. The Type C concrete anchor CA is bolt that is inserted through a top drilled opening in the concrete and is connected to a bolt at its bottom end section. The top of the concrete opening can optionally include a counter sink portion so that the top of the bolt is positioned below a top surface of the concrete section. As can be appreciated, other types of concrete anchors can be used to secure the improved plate system to the concrete sections.

Figure 16:
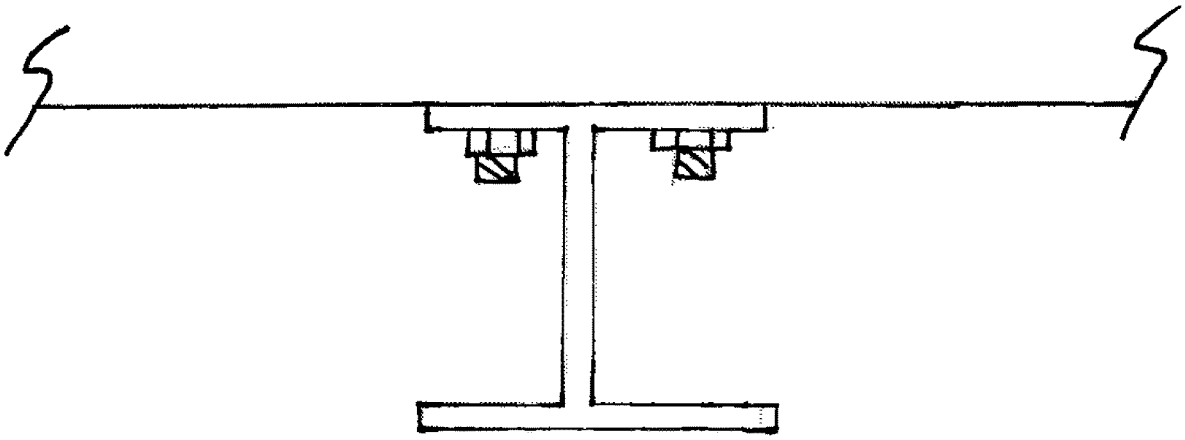
FIG. 16 is an end view of another non-limiting configuration of the improved plate system in accordance with the present disclosure.
Figure 17:
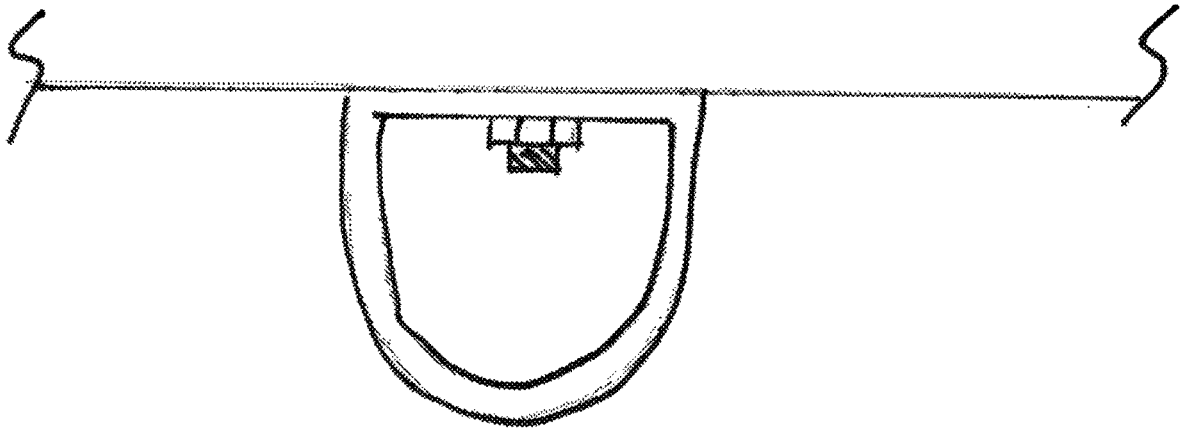
FIG. 17 is an end view of another non-limiting configuration of the improved plate system in accordance with the present disclosure.
Figure 18:
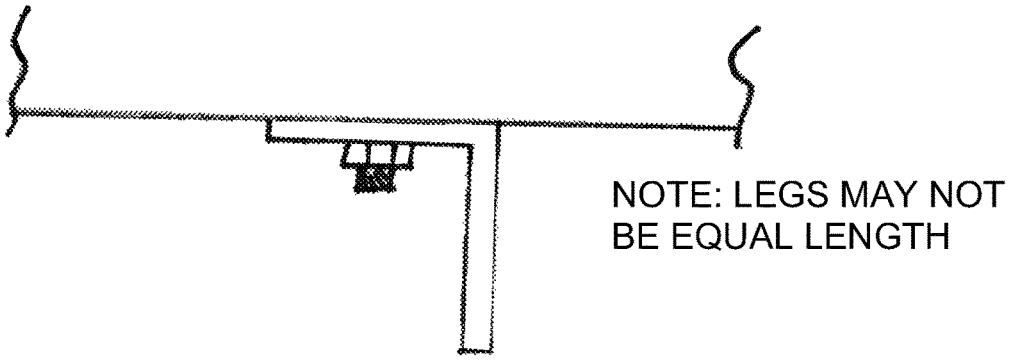
FIG. 18 is an end view of another non-limiting configuration of the improved plate system in accordance with the present disclosure.
Figure 19:
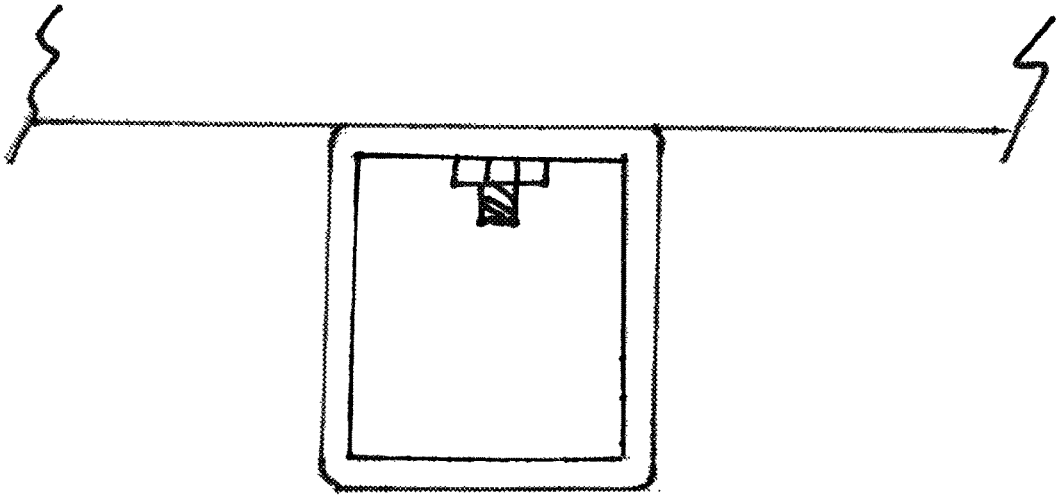
FIG. 19 is an end view of another non-limiting configuration of the improved plate system in accordance with the present disclosure.

Referring now to FIGS. 16-19, additional non-limiting reinforcement structure are illustrated. FIG. 16 illustrates a T-Shaped reinforcement structure that is positioned along the central longitudinal axis of the plate body. FIG. 17 illustrates a U-shaped reinforcement structure that is centrally located along the central longitudinal axis of the plate body. FIG. 18 illustrates a linear reinforcement structure that is positioned parallel to the central longitudinal axis of the plate body and located along the side edge of the plate body. FIG. 19 illustrates a C-Shaped reinforcement structure that is centrally located along the central longitudinal axis of the plate body, wherein the sides are generally parallel to one another. As can be appreciated, many other shaped reinforcement structures can be used.

A non-limiting method for using the improved plate system to repair the flange-to-flange connections for pre-cast and pre-stressed double tee systems includes the steps of:

A. Providing two concrete sections that need to be connected and/or repaired.

B. Providing the improved plate system in accordance with the present disclosure.

C. Positioning the improved plate system on the underside of the two concrete sections.

D. Securing the improved plate system on the underside of the two concrete sections.

When the improved plate system includes one or more shims, one or more of the shims can be removed to account for unevenness between the two concrete sections. The one or more shims are removed prior to securing the improved plate system on the underside of the two concrete sections.

The improved plate system is generally secured to the underside of the two concrete sections by the use of one or more concrete anchors; however, it will be appreciated that an adhesive material (e.g., resin material, etc.) can also be used with the one or more concrete anchors, or can alternatively be used instead of the one or more concrete anchors to secure the improved plate system to the underside of the two concrete sections.

It will thus be seen that the objects set forth above, among those made apparent from the preceding description, are efficiently attained, and since certain changes may be made in the constructions set forth without departing from the spirit and scope of the disclosure, it is intended that all matter contained in the above description and shown in the accompanying drawings shall be interpreted as illustrative and not in a limiting sense. The disclosure has been described with reference to preferred and alternate embodiments. Modifications and alterations will become apparent to those skilled in the art upon reading and understanding the detailed discussion of the disclosure provided herein. This disclosure is intended to include all such modifications and alterations insofar as they come within the scope of the present disclosure. It is also to be understood that the following claims are intended to cover all of the generic and specific features of the disclosure herein described and all statements of the scope of the disclosure, which, as a matter of language, might be said to fall therebetween.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed:

1. A plate system for use in repairing the flange-to-flange connections for pre-cast and pre-stressed double tee systems by connecting the plate system to the underside of the flange-to-flange connections; said plate system comprises a plate body and a plurality of connection arrangements; said plate body is formed of no more than 25 wt. % metal; said plate body includes one or more layers of fibers that are bonded together by a bonding material; one or more of said connection arrangements configured to facilitate in securing said plate system to the underside of the flange-to-flange connections.

2. The plate system as defined in claim 1, wherein said one or more layers of fibers are formed of one or more materials selected from the group consisting of carbon fibers, glass fibers, aramid fibers, boron fibers, hemp fibers, basalt fibers, nylon fibers, Dyneema™ fibers (ultra-high molecular weight polyethylene fiber), Zylon™ fibers (thermoset liquid-crystalline polyoxazole fibers), and/or fiberglass fibers.

3. The plate system as defined in claim 1, wherein one or more of said plurality of connection arrangements includes an opening that passes fully through said plate body and is spaced inwardly from a peripheral edge of said plate body.

4. The plate system as defined in claim 2, wherein one or more of said plurality of connection arrangements includes an opening that passes fully through said plate body and is spaced inwardly from a peripheral edge of said plate body.

5. The plate system as defined in claim 1, further including a removable section that is detachable connected to a top surface of said plate body.

6. The plate system as defined in claim 4, further including a removable section that is detachable connected to a top surface of said plate body.

7. The plate system as defined in claim 5, wherein said removable section includes one or more fiber layers.

8. The plate system as defined in claim 6, wherein said removable section includes one or more fiber layers.

9. The plate system as defined in claim 1, further including one or more reinforcement structures formed on a bottom surface of said plate body.

10. The plate system as defined in claim 8, further including one or more reinforcement structures formed on a bottom surface of said plate body.

11. The plate system as defined in claim 9, wherein said reinforcement structure includes one or more fiber layers.

12. The plate system as defined in claim 10, wherein said reinforcement structure includes one or more fiber layers.

13. The plate system as defined in claim 12, wherein said a composition of said fibers layers of said reinforcement structure and said removable layer are the same as a composition of said fiber layers of said plate body.

14. The plate system as defined in claim 13, wherein each of said plate body, said reinforcement structure and said removable layer is formed of no more than 5 wt. % metal.

15. The plate system as defined in claim 1, wherein bonding material is a resin material.

16. A method for repairing the flange-to-flange connections for pre-cast and pre-stressed double tee systems comprising:

A. Providing two concrete sections that need to be connected and/or repaired;

B. Providing a plate system; said plate system includes a plate body and a plurality of connection arrangements; said plate body is formed of no more than 25 wt. % metal; said plate body includes one or more layers of fibers that are bonded together by a bonding material; one or more of said connection arrangements is configured to facilitate in securing said plate system to said two concrete sections;

C. Positioning said plate system on the underside of said two concrete sections; and D. Securing said plate system to an underside of said two concrete sections.

17. The method as defined in claim 16, wherein said plate system includes one or more removable sections that are detachable connected on or above a top surface of said plate body; and further including the step of removing at least one of said removable sections from said plate system prior to said step or securing so as to adjust for unevenness between said underside of said concrete sections during said step securing said plate system to an underside of said two concrete sections.

18. The method as defined in claim 16, wherein said step of securing includes a) use of one or more one or more concrete anchors that are at least partially positioned through one or more of said connection arrangements in said plate body, and/or b) use of an adhesive material on a top surface of said plate system.

19. The method as defined in claim 17, wherein said step of securing includes a) use of one or more one or more concrete anchors that are at least partially positioned through one or more of said connection arrangements in said plate body, and/or b) use of an adhesive material on a top surface of said plate system.

20. The method as defined in claim 16, wherein said plate system includes one or more reinforcement structures formed on a bottom surface of said plate body.

* * * * *